US005675956A

United States Patent [19]

Nevin

[11] Patent Number: 5,675,956

[45] Date of Patent: Oct. 14, 1997

[54] POST AND POLE CONSTRUCTION USING COMPOSITE MATERIALS

[76] Inventor: Jerome F. Nevin, 2383 Northshore Rd., Bellingham, Wash. 98226

[21] Appl. No.: 654,939

[22] Filed: May 29, 1996

Related U.S. Application Data

[63] Continuation of Ser. No. 232,500, Apr. 25, 1994, abandoned.

[51] Int. Cl.[6] ..... E04C 3/34

[52] U.S. Cl. ..... 52/726.1; 52/726.4; 52/745.18; 52/723.1; 428/34.4; 428/36.8; 428/36.9; 428/36.91; 428/192; 428/99; 264/262

[58] Field of Search ..... 52/725, 726.1, 52/726.3, 726.4, 727, 296, DIG. 9, 745.17, 745.18, 723.1; 428/36.9, 36.91, 36.92, 35.7, 36.4, 36.8, 34.4, 192, 99; 264/262

[56] References Cited

U.S. PATENT DOCUMENTS

| | | | |
|---|---|---|---|
| 359,434 | 3/1887 | Datesman | 256/51 |
| 693,061 | 2/1902 | Pegg | 256/48 |
| 1,111,909 | 9/1914 | Kramer | 264/267 |
| 1,615,815 | 1/1927 | Birdsey | 52/725 |
| 1,709,893 | 4/1929 | Bemist | 52/724 |
| 1,805,253 | 5/1931 | Nadel | 52/726.3 |
| 1,858,512 | 5/1932 | Langenberg et al. | 52/725 |
| 1,971,051 | 8/1934 | Keiner et al. | 52/725 |
| 2,853,742 | 9/1958 | Dasher | 264/166.9 |
| 2,873,503 | 2/1959 | Davis | 249/48 |
| 2,991,533 | 7/1961 | Reid et al. | 249/120 |
| 3,336,649 | 8/1967 | Bruns | 264/71 |
| 3,388,887 | 6/1968 | Frost, Jr. | 249/120 |
| 3,399,426 | 9/1968 | Weasel | 264/166.9 |
| 3,479,704 | 11/1969 | Reed | 425/89 |
| 3,564,804 | 2/1971 | Archer et al. | 52/726.3 |
| 3,806,562 | 4/1974 | Lamort | 264/166.9 |
| 3,957,250 | 5/1976 | Murphy | 256/51 |
| 3,991,532 | 11/1976 | Buxham | 52/725 |
| 4,019,301 | 4/1977 | Fox | 52/727 |
| 4,023,374 | 5/1977 | Colbert et al. | 52/725 |
| 4,025,212 | 5/1977 | Black | 52/726.3 |
| 4,028,288 | 6/1977 | Turner | 264/166.9 |
| 4,045,602 | 8/1977 | Smith | 264/166.9 |
| 4,067,826 | 1/1978 | Emery | 264/166.9 |
| 4,134,568 | 1/1979 | Christian | 249/173 |
| 4,166,347 | 9/1979 | Pohlman et al. | 52/725 |
| 4,187,352 | 2/1980 | Klohbie | 264/166.9 |
| 4,242,851 | 1/1981 | Pohlman et al. | 52/726.3 |
| 4,255,071 | 3/1981 | Koppers et al. | 52/724 |
| 4,327,703 | 5/1982 | Destree | 52/745.17 |
| 4,427,818 | 1/1984 | Prusinski | 264/166.9 |
| 4,522,669 | 6/1985 | Nordin | 264/256 |
| 4,600,459 | 7/1986 | Proctor | 264/267 |
| 4,820,469 | 4/1989 | Walsh et al. | 264/166.9 |
| 4,824,627 | 4/1989 | Hammer et al. | 264/166.9 |
| 4,910,940 | 3/1990 | Grady, II | 52/726.3 |
| 5,094,905 | 3/1992 | Murray | 428/218 |
| 5,103,616 | 4/1992 | Nordberg | 52/585.1 |
| 5,172,528 | 12/1992 | Clarke | 52/198 |
| 5,229,051 | 7/1993 | Martin | 264/71 |
| 5,271,974 | 12/1993 | Upchurch | 428/36.91 |
| 5,288,174 | 2/1994 | Kjersem et al. | 52/726.3 |
| 5,312,658 | 5/1994 | Griffith | 428/36.91 |
| 5,391,226 | 2/1995 | Frankowski | 52/DIG. 9 |
| 5,405,668 | 4/1995 | Sandt | 428/36.9 |

FOREIGN PATENT DOCUMENTS

| | | |
|---|---|---|
| 67958 | 10/1975 | Australia . |
| 623370 | 6/1927 | France . |
| 2012584 | 9/1971 | Germany . |
| 2012584 | 2/1972 | Germany . |

(List continued on next page.)

*Primary Examiner*—Rena Dye
*Attorney, Agent, or Firm*—Robert L. Harrington

[57] ABSTRACT

A post and/or pole segment formed by filling a form with a composite mixture of a bonding agent and a filler material. The composite mixture is placed in a form in a fluid state and allowed to solidify. The form is retained as an integral member of the post and/or pole segment. The post and/or pole segments are arranged to be connected in an end to end arrangement to form a post or pole of extended length. The form and the composite mixture of the post and/or pole segment are of recycled material.

7 Claims, 2 Drawing Sheets

FOREIGN PATENT DOCUMENTS

| | | |
|---|---|---|
| 2144536 | 3/1972 | Germany . |
| 2211562 | 4/1973 | Germany . |
| 36542 | 9/1977 | Japan . |
| 1017480 | 1/1986 | Japan . |
| 16923 | 5/1904 | Sweden . |
| 359317 | 2/1962 | Switzerland . |
| 490921 | 2/1976 | U.S.S.R. . |
| 642446 | 1/1979 | U.S.S.R. . |
| 1220763 | 1/1971 | United Kingdom . |
| 2062048 | 5/1981 | United Kingdom . |
| 2130784 | 6/1984 | United Kingdom . |

POST AND POLE CONSTRUCTION USING COMPOSITE MATERIALS

This application is a continuation of application Ser. No. 08/232,500 filed on Apr. 25, 1994, now abandoned.

BACKGROUND INFORMATION

1. Field of the Invention

This invention relates to post and pole construction and more particularly relates to constructing posts and poles utilizing a composite mixture of a bonding agent and a filler material filled and cured within a desired form. The form becomes a structural part of the post and/or pole.

2. Background of the Invention

Posts and poles were once most often made of wood. (As used herein, posts and poles include various forms and definitions of elongated support members, e.g., pilings.) Lately, the decreasing supply of timber, the restrictions on material to treat the wooden posts and poles against rot and decay has caused suppliers to seek other materials as substitutes for wood in the fabrication and construction of posts and poles.

Concrete, a mixture of portland cement and aggregate material, has been one of the choices. There are several factors that deter the use of concrete in its usual form (mixture). Some of the factors that deter the use of concrete are; it is very heavy and therefore expensive to transport, it will only withstand a limited amount of bending before fracturing, it is subject to deterioration by some weather conditions, such as water freezing in a crack of the concrete and it is difficult to drive fasteners into it.

The heavy weight of the concrete provides some difficulty in handling and increases the cost of transportation as compared to a wooden post and/or pole having the same specification as to the length and strength and so forth.

There are tools that will forcibly drive fasteners, such as nails into concrete, but the generally narrow section of the all concrete post or pole will not withstand this type of fastener, particularly if multiple fasteners are placed in close proximity to each other.

BRIEF SUMMARY OF THE INVENTION

The present invention utilizes a mixture of a bonding agent and a filler material, preferably including pieces of rubber, which will setup to a hardened state. The mixture, when in a fluid state is filled into forms. The forms define the length and shape of the post or pole segment that is to be formed and the forms are retained to become a part of the post or pole segment structure.

A preferred embodiment of the present invention has a form of concentric cylinders produced from plastic tubing, e.g., PVC. That is a cylinder is fitted within a cylinder. The void between the cylinders is filled with a mixture that will set up to a hardened state, which in the preferred embodiment is a mixture of portland cement, water and pieces of filler material, such as rubber chips of shredded tire discards. The post or pole segment formed thus has a hollow center, the hollow center being determined by the size of the inner cylinder of the form. The posts and/or pole segments may be produced in lengths to suit the requirements. The pole segments can be arranged to be fixedly joined in an end to end arrangement to form a pole (or post) of desired length.

The composite mixture of cement and rubber fill material inside the cylinders of plastic, reduces the weight of the post and/or pole segment as compared to one produced of solid concrete. The weight of the post and/or pole segment is further reduced in weight by its hollow center. In addition to the weight reduction the addition of the rubber fill material provides other desirable attributes. The finished post and/or pole segment will bend to a greater degree than one of all concrete and fasteners, such as nails, may be driven into and retained in the composition much more readily than into one of all concrete. Also characteristic of the hollow pole or post is that like wood posts, the posts of this invention can be made to float by capping or sealing the ends. Unlike wood, the posts of this invention are not subject to deterioration, e.g., marine insect infestation and provide a replacement for marine structures made of floating logs.

Refer now to the drawings and the detailed description for a complete understanding of the invention.

DESCRIPTION OF THE PREFERRED EMBODIMENT

The present invention includes a form that defines the geometry of the end product, e.g., a post or pole segment. The form is arranged to become part of the structure of the end product and has a defined space for receiving a mixture of a bonding agent and a filler material that will set up to a solid state.

Figure 1:
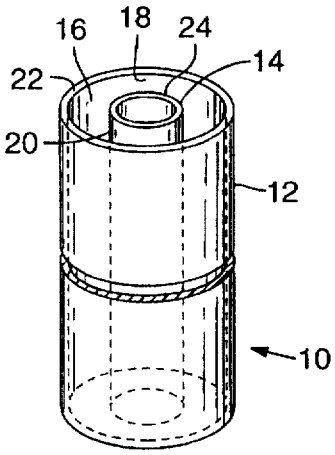
FIG. 1 is a view of a form utilized in forming the post and pole segments of the present invention.

The cylinders are preferably plastic such as poly vinyl chloride (PVC). The PVC is plastic that does not deteriorate and cause leaking of contaminants into the soil. The form 10 has an outer cylinder 12 and a smaller diameter inner cylinder 14 fitted within the outer cylinder 12. The outer cylinder 12 and the inner cylinder 14 are fitted together concentrically to provide a uniform space 16 between the inner wall 18 of the outer cylinder 12 and the outer wall 20 of the inner cylinder 14. The cylinders 12 and 14 are provided in lengths to suit the desired length of the end product, whether it be a post or a pole segment. For example if the end product is a single length unit, such as a post, the lengths of the cylinders may be on the order of five, six, seven feet and so forth depending on the end product requirement and similarly if the end product is a pole segment, the length will be according to the length required. A fifteen foot pole may, for example, be an end to end assembly of a five foot pole segment and a ten foot pole segment. FIG. 1 is intended to show the basic concentric arrangement of the outer and inner cylinders 12 and 14. As will be seen and described later the end 22 of the cylinder 12 and end 24 of cylinder 14 will be arranged spatially and altered to suit the requirement of the end product, whether the product be a single length post or a pole segment. The space 16 of the form 10 will be filled with a mixture of a bonding agent and a filler material that will set up to a solid state.

Figure 2:
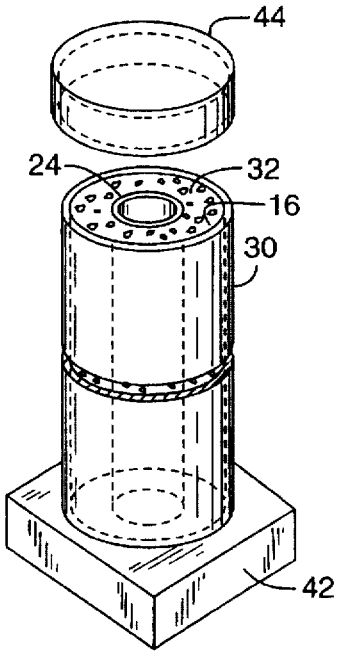
FIG. 2 is a view of a post of the present invention by utilizing the form of FIG. 1.

Refer now to FIG. 2 of the drawings which illustrates a post 30 that has been produced by utilizing the form 10 of FIG. 1. As previously mentioned, the space 16 of the form 10 is filled with a mixture of a bonding agent and a filler material. In this embodiment, a mixture of portland cement #2, water and a filler material referred to as rubber chips are utilized as the material that will set up to a solid state. The mixture is preferably 25% portland cement #2 and 75% rubber chips, the percentages referring to volume measure. The filler material referred to as rubber chips in this embodiment are chips formed from used tires as by shredding. The filler material is simply referred to as rubber chips but includes all of the components of the used tire such as the steel in the bead, the cords, the belting and so forth. The components of the tire are believed to aid in the bonding of the portland cement to the chips produced from the tire. The chips are preferably uniformly sized and are preferably ¾ inch minus. That is the chips may be somewhat smaller than ¾ inch, but preferably do not exceed ¾ inch as measured along a major dimension of the chip.

The outer cylinder 12 and the inner cylinder 14 of the form 10 for many applications are preferably formed from re-cycled plastic such as milk containers. In other applications at best the outer cylinder 12 is made of poly vinyl chloride (PVC) which has greater resistance to deterioration.

Figure 3:
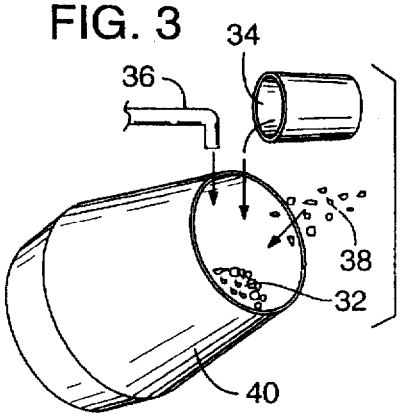
FIG. 3 diagrammatically illustrates mixing a composite mixer utilized in the construction of the posts and/or pole segments of the present invention.

The portland cement #2, designated by numeral 34, water 36 and rubber chips 38 are mixed together in a conventional mixer 40 as indicated in FIG. 3 to uniformly mix the components into a mixture 32. The components of the mixture 32 are mixed adequately to uniformly distribute the rubber chips 38 throughout. Care is taken to ensure the mixture 32 is dry enough to prevent the chips 38 from being buoyed up to the top of the mixture.

As shown in FIG. 2, the lower end of the form 10 is placed on a surface, such as a vibrator 42 to close the lower end of the form 10. In this embodiment the outer cylinder 12 and the inner cylinder 14 are of equal length and have their ends flush with each other. The upper end 24 of the inner cylinder 14 is plugged or capped by conventional methods and the space 16 of the form 10 is filled with the mixture 32. The form 10 may be vibrated by a vibrating device 42 to assure uniform filling and distribution of the mixture 32 in the space 16 of the form 10. If desired, each end of the post 30 may be capped by an end cap 44. If capping is desired, an end cap 44 is fitted to the lower end of the post 30 prior to filling the space 16 with the mixture 32. The mixture 32 placed in the space 16 cures to a solidified state. The form 10 is retained on the post 30 and thus becomes an integral part of the post 30.

The form 10 may be altered to facilitate connecting the formed posts or pole segments together in an end to end arrangement to form a unit that is longer than that of the form 10. Generally reference to a product formed by utilizing the form 10 and intended for use in that length will be referred to as a post and reference to products that are intended to be connected in an end to end arrangement will be referred to as a pole segment. A pole will generally be formed by connecting two or more pole segments together in an end to end arrangement. It will be appreciated that the terms post, pole segment and pole have some overlap in their definition. A post for example does not have a minimum length or maximum length and may exceed in length a member which is normally referred to as a pole. An end post of a fence that defines a gateway, may for example have greater length than a pole utilized to support a light. Similarly, a post may also be an assembly of two or more segments.

Figure 4:
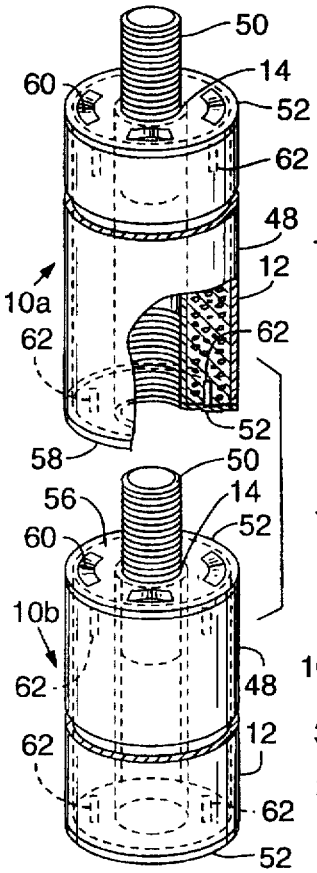
FIG. 4 is a view showing one arrangement for connecting pole segments of the present invention together in an end to end arrangement.

FIG. 4 illustrates one manner of connecting two members, such as two pole segments 48 as illustrated in FIG. 2. A metal threaded rod (or shaft) 50 sized to threadably fit in the inner cylinder 14 has a lower metal plate 52 threadably installed on the rod 50 and secured in position near the center point of the rod 50 as by welding. The thread form on the rod 50 is preferably of the self tapping type and will generate a thread form on the interior of the inner cylinder 14 when installed. The rod 50 with the lower plate 52 attached is threadably installed in one end of the inner cylinder 14 of the form **10*b* as illustrated in the lower portion of FIG. 4. The form 10*b* is inverted from the position shown to facilitate filling the space 16 with the mixture 32. Another plate 52 is fitted to the opposite end of the form 10*b* when the space 16 has been filled with the mixture 32. The form 10*b* filled with the mixture 32 and having a plate 52 and rod 50 affixed at one end and another plate 52 affixed at the opposite end defines a pole segment 48. The pole segment 48 will have one end designated as 56 as shown on form 10*b* and will have an opposite end designated as 58 as shown on form 10*a*. The two pole segments 48 are installed one to the other by inserting the end of the shaft 50 extending out of the end 56 of form 10*b* into the inner cylinder 14 of end 58 of form 10*a* and rotating the pole segments 48 one to the other to threadably install the rod 50 into the inner cylinder 14 of the form 10*a*. The plates 52 have extending cooperating ridges or inclines 60 that will cooperatively interlock when the plates come together and are rotated one to the other during installation. This will prevent the two connected pole segments 48 from separating. It is preferable to have anchors 62 extending from the plates 52 that will be entrained into the mixture 32. When the mixture 32 solidifies, the plates 52** will thus be securely affixed in position.

Figure 5:
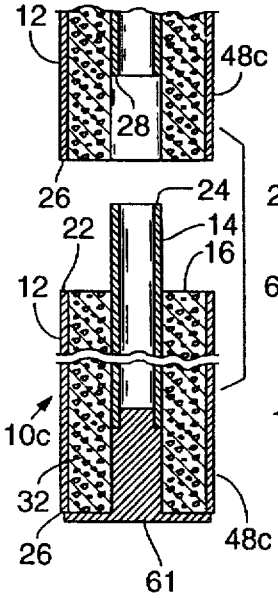
FIGS. 5, 6 and 7 are views showing alternate arrangements for connecting pole segments of the present invention together in an end to end arrangement.

FIG. 5 illustrates another form **10*c* utilized to produce a pole segment 48*c*. The form 10*c* of FIG. 5 is similar to form 10 of FIG. 1 except that the end 24 of the inner cylinder 14 extends beyond the end 22 of the cylinder 12 and the opposite end 28 of the cylinder 14 is inset within the lower end 26 of the cylinder 12 as shown in the figure. A removable plug 61 having the same extending diameter as the inner cylinder 14 is installed to extend from the lower end 28 of the inner cylinder 14 with its bottom end flush with the lower end 26 of the outer cylinder 12. The space 16 is filled with the mixture 32 and is solidified. The mixture 32 is filled to be flush with the upper end 22 of the outer cylinder 12. The upper end 24 of the inner cylinder 14 thus extends above the mixture 32. The plug 61 is removed after the mixture 32 has hardened sufficiently. The pole segment 48*c* is thus arranged to be connected in an end to end arrangement with another pole segment 48*c*. The pole segment 48*c* is joined to another pole segment 48*c* by joining opposite ends of two pole segments 48*c* together. A suitable adhesive available and known throughout the trade is applied to the interconnecting components of each pole segment 48*c* to fixedly join the pole segments 48*c* together. The extending end 24 of the inner cylinder 14 of one pole segment 48*c* will fit in the cavity formed in the mixture 32 by the plug 61 of the other pole segment 48*c* and the lower end 26 of the outer cylinder 12 of one pole segment 48c will be in abutment with the upper end 22 of the outer cylinder 12 of the other pole segment 48c. Additionally the ends of the formed mixtures 32 of the two pole segments 48c will be in abutment. The two pole segments 48c** are thus securely bonded together.

Figure 6:
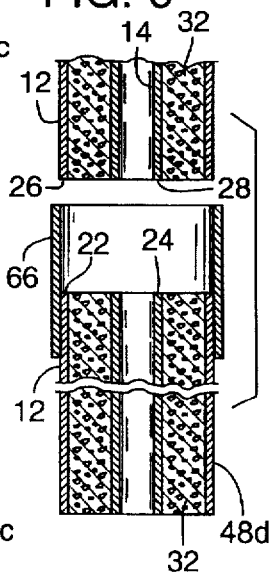

FIG. 6 illustrates another variation in joining two or more pole segments 48d together. The pole segment 48d is formed by utilizing the basic form 10 as illustrated in FIG. 1. The form 10 is filled with the mixture 32 as previously described and is solidified. A coupling 66 is adhesively bonded to the upper end 22 of the outer cylinder 12 by a known adhesive as shown. Two or more pole segments are adhesively joined together by applying a known adhesive to the interior of the coupling 66, including the exposed surface of the mixture 32 and the end 24 of the inner cylinder 14 and to the exterior of the outer coupling 12 at end 26 of another pole segment 48d including the exposed end of the mixture 32 and the end 28 of the inner cylinder 14. The assembly is completed by inserting end 26 of the outer cylinder 12 of a pole segment 48d to which adhesive has been applied into the coupling 66 of another pole segment 48d to which adhesive has been applied.

Figure 7:
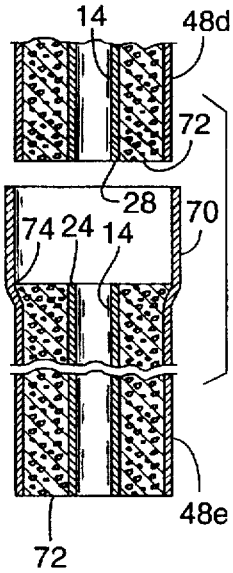

FIG. 7 illustrates another variation in the basic form 10 of FIG. 1 to produce pole segments 48e. The form 10e of FIG. 7 has an outer cylinder 12e that has a flared end 70. The flared end 70 is sized to receive an end 72 of another pole segment 48e to facilitate joining the pole segments together. As shown the inner cylinder 14 extends from the bottom 72 up to the neck 74 of the flared end 70. The form 10e is filled with the mixture 32 in a manner previously described with the mixture being flush with the upper end 24 of the inner cylinder 14. A pole segment 48e is joined to another pole segment 48e by applying adhesive to the end 72 of one pole segment including the exposed end of the mixture 32 and the end 28 of the inner cylinder 14 and applying adhesive to the interior of the flared end 70, to the exposed end of the mixture 32 and to the end 24 of the inner cylinder 14 of another pole segment 48e. The end 72 of the pole segment 48e to which adhesive has been applied is inserted into the flared end 70 of another pole segment to which adhesive has been applied. The two pole segments 48e are thus adhesively bonded together.

As previously mentioned, the posts and/or pole segments of the present invention may be utilized singly or may be utilized as an end-to-end assembly of multiple posts and/or pole segments to form a post or pole of greater length.

The posts and/or pole segments of the present invention are constructed of materials that will not degrade and, therefore, do not contaminate the environment. Since they do not degrade, they are particularly suited to applications where an end portion is inserted into the ground.

Figure 8:
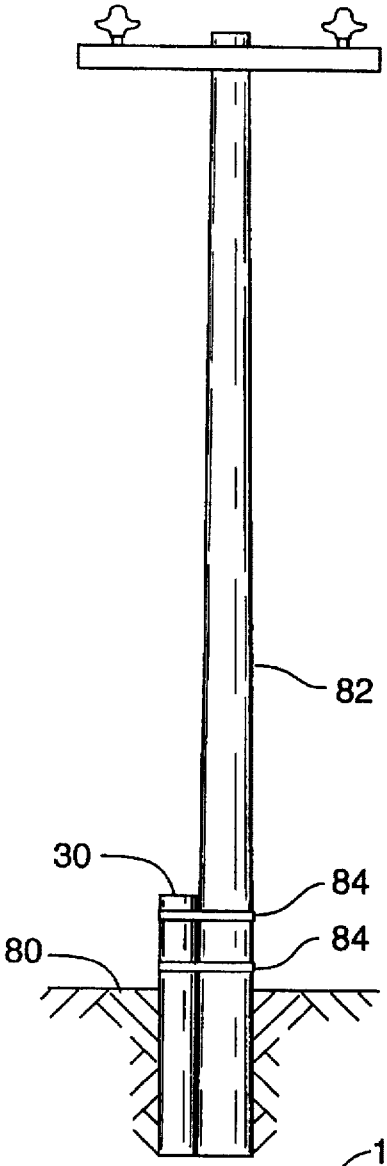
FIG. 8 is a view illustrating a use of the post/pole segment of the present invention.

FIG. 8 illustrates one example of using a post of the present invention. The post, such as a post 30 of FIG. 2, is inserted in the ground 80 adjacent a utility pole 82 generally to the same depth as the pole 82. The post 30 has sufficient length to extend above the surface of the ground 80 as shown. The post 30 is fixedly attached to the pole 82 by bands 84. The post 30 thus reinforces the pole 82 at its most vulnerable area which is near the ground 80. The post 30 since it will not degrade is well suited to this application.

Figure 9:
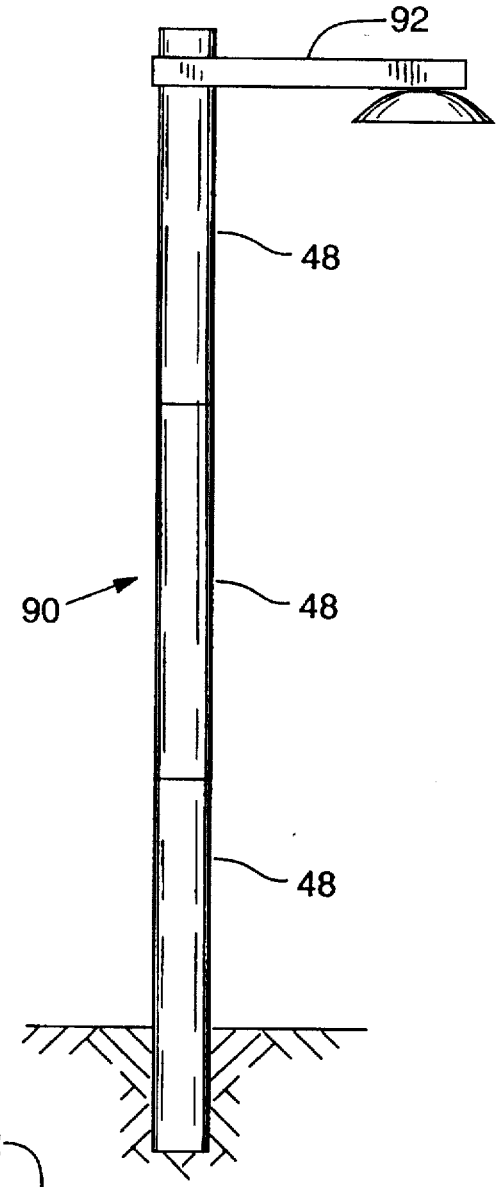
FIG. 9 is a view illustrating a pole formed by connecting multiple post/pole segments of the present invention in an end to end arrangement; and, FIG. 10 is a view illustrating a clamp attached to a post/pole segment of the present invention.

FIG. 9 illustrates an example of multiple pole segments, such as segments 48 of FIG. 4–7, connected in an end-to-end arrangement to form a pole 90. The pole 90 supports a light fixture 92.

Most often brackets, fixtures (such as the light fixture 92 of FIG. 9) and other items are to be attached to a post or pole. The composition of the cement and rubber chips of the mixture 33 permits the ready insertion or attachment of fasteners as compared to a mixture of all concrete. The resiliency and compressibility of the rubber chips is believed to aid in the insertion or attachment of fasteners.

Figure 10:
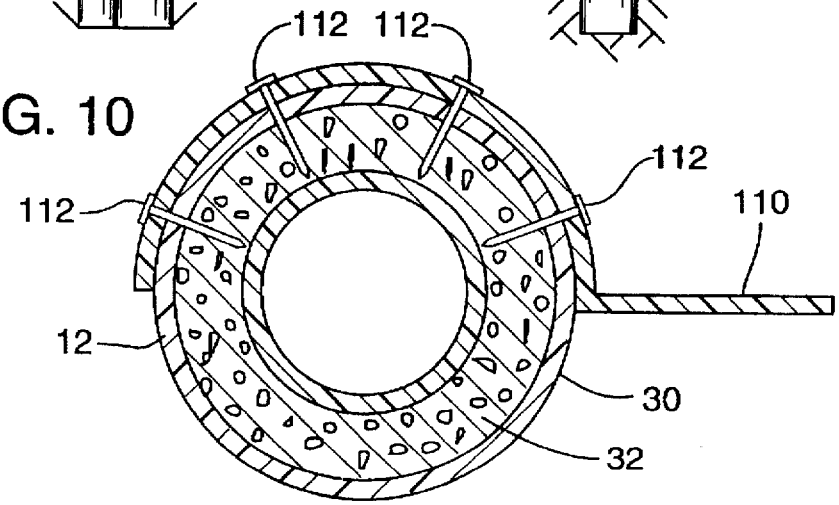

FIG. 10 illustrates one example of a manner of attaching a bracket 110 to post and/or pole segment such as a post 30. Multiple fasteners 112 are driven through the outer cylinder 12 into the mixture 32. The rubber chips of the mixture 32 not only aid in accepting the fasteners but also due to their resiliency act to retain the fasteners.

The drawings and description have by way of example been directed to forming posts or pole segments utilizing a form of concentric cylinders and modifications thereof. Several examples have been given to show how multiple pole segments (posts) may be connected in an end to end arrangement to form a pole (post). It will be apparent to those skilled in the art that other geometric shapes may be utilized. Frequently it is desired to have posts or poles that are square, rectangular or even triangular in shape. The members utilized in the forms would be selected to suit the requirements. For a square post (pole segment), the outer member would have a square cross section. The inner member may be square in section, circular in section or a section of the user's choosing.

All of the end products described and illustrated are shown to have a hollow center which is determined by the shape of the inner member (cylinder) of the form. If desired, the end product, be it a post or pole segment may have a solid core by simply eliminating the inner member (cylinder).

The invention is therefore not to be limited to the embodiment(s) described and illustrated but it to be determined from the appended claims.

What is claimed is:

1. A pole comprised of end-to-end pole segments, each segment including an outer sleeve of weather resistant plastic material having opposed ends, an inner sleeve within laid outer sleeve extended substantially throughout the entire length of the outer sleeve and separated from said outer sleeve to provide a tubular spacing from one end to the other between the sleeves and a cylindrical spacing within said inner sleeve, said tubular spacing being the only part of the segment filled with a strengthening concrete mixture which mixture completely fills the spacing between the sleeves when cured, said tubular spacing and said cylindrical spacing cooperatively sized to provide the post with a desired strength and a minimal weight, the ends of at least two segments in abutting relation and including a fastener fastening the abutted ends of the segments together.

2. A pole as defined in claim 1 wherein said fastener is a sleeve segment of weather resistant plastic material that surrounds the juncture between the abutted ends, said sleeve segment being secured to said abutted ends.

3. A pole as defined in claim 2 wherein said sleeve segment is an extension of the sleeve of one of said posts expanded in diameter to accept the end of the other post whereby said end of the other post is inserted into the sleeve segment, and an adhesive securely bonding the sleeve segment to the inserted end of the other post.

4. A pole as defined in claim 1 wherein said fastener is a rod projected into the cylindrical cavities of each of the abutted ends and secured to the end of the inner sleeves defining said cylindrical cavities.

5. A pole as defined in claim 4 wherein the rod is threaded with self-tapping threads and is sized to the inner sleeves for threadably fastening said rod to said inner sleeves upon screw insertion of the rod into the inner sleeves.

6. A post produced by the steps of:

(a) determining a desired post member size and strength;

(b) providing an outer weather resistant plastic sleeve having the desired post member size and an inner sleeve supported in said outer sleeve substantially the entire length of said outer sleeve to provide a predetermined spacing between the sleeves;

(c) pouring a mixture of concrete only into the spacing between the sleeves and curing said mixture, the cured mixture completely filling the spacing between the sleeves and having a strength as determined by the predetermined spacing filled with the cured mixture that satisfies said desired strength;

(d) producing a plurality of post members in accordance with steps (a), (b) and (c);

(e) aligning the poet members in end-to-end abutment; and (f) providing a common sleeve portion surrounding the abutted post ends, said sleeve portion secured to said abutted post members.

7. A post member as defined in claim 6 wherein said mixture of concrete includes about 75% by volume of rubber chips.

* * * * *

UNITED STATES PATENT AND TRADEMARK OFFICE

CERTIFICATE OF CORRECTION

PATENT NO. : 5,675,956

DATED : October 14, 1997

INVENTOR(S) : Nevin

It is certified that error appears in the above-identified patent and that said Letters Patent is hereby corrected as shown below:

Col. 6, line 38, change "laid" to --said--;

Col. 8, line 3, change "poet" to --post--.

Signed and Sealed this

Twenty-third Day of December, 1997

Bruce Lehman

*Attest:*

BRUCE LEHMAN

*Attesting Officer*

*Commissioner of Patents and Trademarks*